United States Patent [19]

Nose et al.

[11] Patent Number: 4,590,892

[45] Date of Patent: May 27, 1986

[54] COOLING SYSTEM FOR VEHICLE

[75] Inventors: Toshimitsu Nose; Toshio Ōhashi, both of Atsugi, Japan

[73] Assignee: Nissan Motor Co., Ltd., Yokohama, Japan

[21] Appl. No.: 657,880

[22] Filed: Oct. 5, 1984

[30] Foreign Application Priority Data

Oct. 7, 1983 [JP] Japan ..... 58-187797

[51] Int. Cl.[4] ..... F01P 5/02

[52] U.S. Cl. ..... 123/41.12; 123/41.49

[58] Field of Search ..... 123/41.11, 41.12, 41.49

[56] References Cited

U.S. PATENT DOCUMENTS

| | | | |
|---|---|---|---|
| 2,729,203 | 1/1956 | Prendergast | 123/41.12 |
| 4,378,760 | 4/1983 | Barge | 123/41.12 |
| 4,381,736 | 5/1983 | Hirayama | 123/41.1 |
| 4,426,960 | 1/1984 | Hart | 123/41.49 |
| 4,475,485 | 10/1984 | Sakakibara et al. | 123/41.12 |

FOREIGN PATENT DOCUMENTS

| | | | |
|---|---|---|---|
| 2026610 | 2/1980 | United Kingdom | 123/41.12 |

*Primary Examiner*—William A. Cuchlinski, Jr.

*Attorney, Agent, or Firm*—Schwartz, Jeffery, Schwaab, Mack, Blumenthal & Evans

[57] ABSTRACT

A cooling system for a vehicle is configured so as to adjust draft volume to the radiator through which engine cooling water is circulated on the basis of the engine operating condition e.g. the temperature of engine cooling water. The cooling system comprises a plurality of motor-fans for cooling the radiator, engine cooling water sensor means provided at radiator hoses, and operational mode control means responsive to the sensor means to selectively control operational modes including a parallel drive mode, a serial drive mode, a partial or single drive mode and an OFF mode. Thus, a desired power supply control for motor-fans is carried out in accordance with an operational mode selected by the operational mode control means, thereby enabling to finely adjust draft volume to effect a desired cooling of the engine.

4 Claims, 3 Drawing Figures

COOLING SYSTEM FOR VEHICLE

BACKGROUND OF THE INVENTION

The present invention relates to a cooling system for a vehicle which drivingly controls a group of motor-fans for air cooling a radiator in an optimum manner.

An example of conventional cooling systems for a vehicle is shown in Japanese Utility Model Published Application No. sho 57-42095.

However, such a conventional cooling system for a vehicle can only switch draft volume directed to a radiator and a condensor in the two steps by driving motor-fans in ON or OFF condition, but is unable to finely adjust the draft volume in accordance with the running conditions of the engine complicatedly varying. Accordingly, this results in inappropriate cooling and lowering of fuel consumption rate.

SUMMARY OF THE INVENTION

With the above in view, an object of the present invention is to provide a cooling system for a vehicle capable of properly adjusting draft volume in accordance with the running conditions of the engine complicatedly varying.

Another object of the present invention is to provide a cooling system for a vehicle enabling to prevent noise produced due to the fact that motor-fans are inadequently driven.

A further object of the present invention is to provide a cooling system for a vehicle making it possible to improve fuel consumption rate.

According to the present invention, there is provided a cooling system for a vehicle configured so as to vary draft volume to the radiator through which engine cooling medium is circulated in accordance with operating conditions of the engine.

BRIEF DESCRIPTIION OF THE DRAWINGS

The features and advantages of a cooling system for a vehicle according to the present invention will become more apparent from the following description taken in conjunction with the accompanying drawings, in which:

FIG. 1 is an expanatory view schematically illustrating a conventional cooling system for a vehicle, FIG. 2 is a block diagram schematically illustrating elementary configuration of a cooling system for a vehicle according to the present invention, FIG. 3 is an explanatory view illustrating an embodiment of a cooling device for a vehicle according to the present invention, and

DETAILED DESCRIPTION OF THE PREFERRED EMBODIMENT

To facilitate the understanding of the present invention, a brief reference will be made to a conventional rangefinder.

Figure 1:
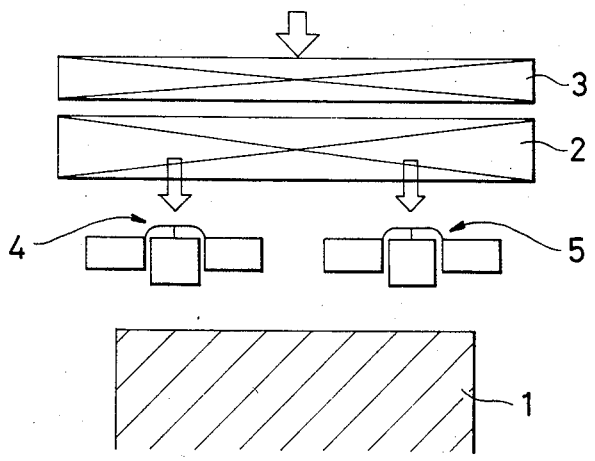
PRIOR ART FIG. 1

Referring to FIG. 1, the conventional system comprises a radiator 2 for air cooling cooling water for an engine (water cooled engine) 1, and a condensor 3 for cooling a vehicle cabin or passenger's compartment provided in parallel with the radiator 2 at the front surface thereof. The conventional system further comprises two motor-fans 4 and 5 for air cooling the radiator 2 and the condensor 3.

In the system there are only two driving modes, in which the motor-fans 4 and 5 are driven or not, for the cooling.

Figure 2:
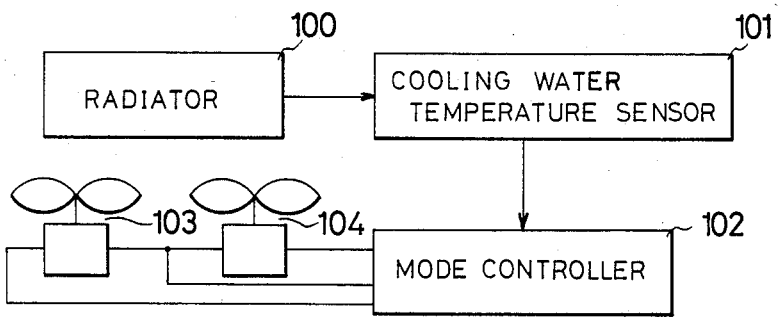

Prior to proceeding with the explanation of the embodiment, the elementary configuration of a cooling system for a vehicle according to the present invention will be described with reference to FIG. 2. The water temperature of the engine cooling water which flows into or from a radiator 100 is sensed by means 101 for sensing engine cooling water temperature. Then, operational mode control means 102 responsive to the engine cooling water sensor means 101 selectively controls the operational mode for a plurality of motor fans labelled as 103 and 104 in this example.

The operational mode is classified into four types. First is to parallely provide a power to the plurality of motor-fans, which is referred to as a "parallel drive mode". Second is to serially provide a power to the group of motor-fans, which is referred to as a "series drive mode". Third is to provide a power only to a single motor among the group of motor-fans, which is referred to as a "partial or single drive mode". Fourth is to turn off all motor-fans, which is referred to as an "OFF mode".

Figure 3:
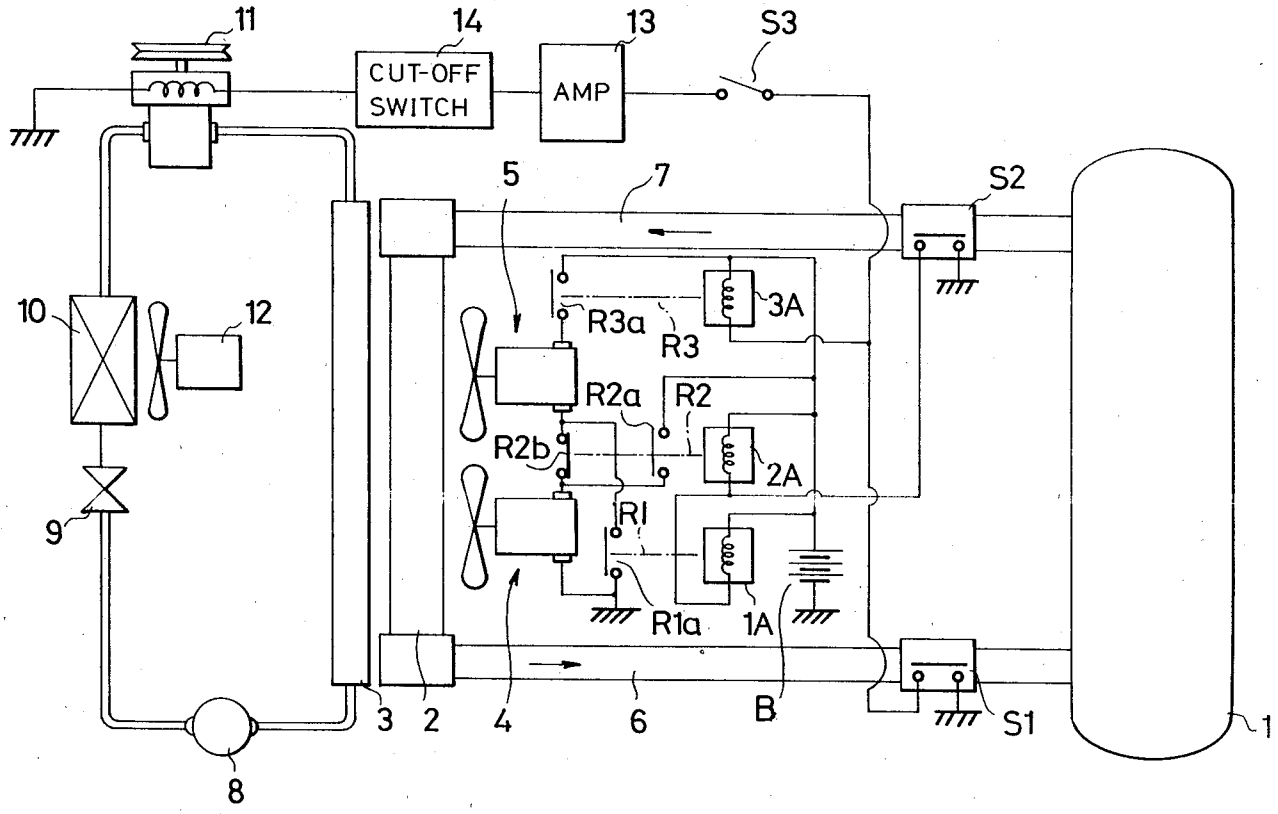

Referring to FIG. 3, there is shown an embodiment of a cooling system for a vehicle according to the present invention.

In this embodiment, similar to the conventional system shown in FIG. 1 the radiator 2 and the condensor 3 are provided in parallel to each other in front of the engine 1.

The condensor 3 is provided for constituting a refrigeration circuit comprising a liquid tank 8, an expansion valve 9, an evaporator 10 and a compressor 11 etc. Air cooled by the refrigeration circuit is admitted into a vehicle cabin by a blower motor 12.

Between the engine 1 and the radiator 2, there are provided two motor-fans 4 and 5. The radiator 2 and the condensor 3 are cooled by air drafts from the motor-fans 4 and 5.

Between these motor-fans 4 and 5 and a power source B, there are provided operational mode control means for motor-fans, comprising electromagnetic relays R1 to R3. The operational mode control means selectively control a plurality of operational modes stated above in accordance with engine operating conditions, e.g. engine cooling water temperature. The detail of the operational modes are as follows. First is to parallely connect the power source B to the motor-fans 4 and 5, which is called "high drive mode". Second is to connect the power source B to either of two motor-fans, which is called a "medium drive mode". Third is to serially connect the power source to the motor-fans, which is called a "low drive mode". Fourth is to turn off the power supply, which is called an "OFF mode".

The relay R1 is provided with a winding 1A and a normally open contact **R1*a* which is closed when the winding 1A is energized. The relay R3 is also provided with a winding 3A and a normally open contact R3*a* which is closed when the winding 3A is energized. Further, the relay R2 is provided with a winding 2A and a normally open contact R2*a* and a normally closed contact R2*b* which are closed and opened, respectively, when the winding 2A** is energized.

The engine 1 and the radiator 2 are interconnected by radiator hoses 6 and 7. A thermoswitch S1 which effects ON-OFF operation depending on a temperature of engine cooling water flowing from the radiator 2 into the engine 1 is provided at the radiator hose 6 so that its sensing area is exposed to the engine cooling water. For instance, when the temperature of the engine cooling water is above 90° C., it turns off.

Likewise, a thermoswitch S2 which effects ON-OFF operation depending on a temperature of engine cooling water flowing from the engine 1 into the radiator 2 is provided at the radiator hose 7 so that its sensing area is exposed to the engine cooling water. For instance, when the temperature of the engine cooling water is above 97° C., the thermoswitch S2 turns on, while when less than 97° C., it turns off. These thermoswitch S1 and S2 may comprise a thermostatic switch or a thermistor.

The thermoswitch S1 has one end grounded, and the other end connected to the relay R3 and to one end of an air conditioner switch S3 is parallel with the relay R3. The air conditioner switch S3 has the other end grounded through an air conditioner amplifier 13, a high voltage cut-off switch 14 and a compressor 11. On the other hand, the thermoswitch S2 has one end grounded the other end connected to the relays R1 and R2.

The operation of the cooling device for a vehicle thus configured will be described with reference to the Table.

Assume that the engine condition is immediately after the engine starts and the air conditioner switch S3 is turned off i.e. when the air conditioner is not used e.g. in spring, fall or winter.

When the temperatures of water flowing from the radiator and thereinto are less than 90° C., respectively, the switches S1 and S2 turn off, so that two motor-fans 4 and 5 become inoperative. Namely, this operational mode is "OFF mode" indicated by OFF in the Table.

Then, when the temperature of water flowing from the radiator is above 90° C. according as the engine warms, the thermoswitch S1 turns on. As a result, the relay winding 3A is energized to close the normally open contact R3*a*. Thus, two motor-fans 4 and 5 are serially connected to the power source B, so that the motor-fans 4 and 5 rotate at a low speed. Namely, this operational mode is "low drive mode" indicated by LO in the Table.

Further, e.g. at idling of the engine, viz., when the temperature of water flowing from the radiator is less than 90° C., while the temperature of water flowing into the radiator is more than 97° C., the thermoswitch S2 turns on. As a result, the relay winding R1A and R2A are energized to close the normally open contacts R1*a* and R2*a*, respectively, and open the normaly closed contact R2*b*. Thus, only the motor fan 4 is connected to the power source B, so that the motor fan 4 rotates at a high speed. This operational mode is "medium drive mode" indicated by MI in the Table.

Further, when the engine rotates at a high speed, i.e. the temperature of water flowing from the radiator is above 90° C. and the temperature of water flowing thereinto is above 97° C., both thermoswitches S1 and S2 turn on. As a result, the relay windings R1A, R2A and R3A are all energized to close the normally open contacts R1*a*, R2*a* and R3*a*, respectively, and open the normally closed contact R2*b*. Thus, the two motor-fans 4 and 5 are parallely connected to the power source B, and they rotate at a high speed. Namely, this operational mode is "high drive mode" indicated by HI in the Table.

TABLE

| Conditions | | 1 | 2 | 3 | 4 | 5 | 6 | 7 | 8 |
|---|---|---|---|---|---|---|---|---|---|
| air conditioner switch | OFF | o | o | o | o | | | | |
| | ON | | | | | o | o | o | o |
| Temperature of water from radiator | up to 90° C. | o | | o | | o | | o | |
| | above 90° C. | | o | | o | | o | | o |
| Temperature of water into radiator | up to 97° C. | o | o | | | o | o | | |
| | above 97° C. | | | o | o | | | o | o |
| driving mode of motor-fans | | OFF | LO | MI | HI | LO | LO | HI | HI |

The case that the air conditioner switch S3 turns on after the engine switch turns on will be described below.

When the air conditioner switch S3 turns on, the relay winding 3A is energized to close the normally open contact R3*a*. Namely, when the air conditioner is used, the normally open contact R3*a* is always closed. When the temperature of water flowing into the radiator is less than 97° C., the two motor-fans 4 and 5 are connected in series independent of the temperature of water flowing from the radiator. Thus, these motors 4 and 5 rotate at a low speed. This operational mode is "low drive mode".

Thereafter, when the temperature of water flowing into the radiator is above 97° C. as a result of the heating of the engine, the two motor-fans 4 and 5 are connected in parallel therewith independent of the temperature of water flowing from the radiator. Thus, these motor-fans 4 and 5 rotate at a high speed. This operational mode is "high drive mode".

Thus, the cooling device for a vehicle according to the embodiment stated above is configured so as to control the operational mode of the motor-fans 4 and 5 in accordance with the combination of three conditions i.e. the ON/OFF state of the air conditioner S3, the temperature of water flowing from the radiator and the temperature of water flowing thereinto. The ratio of the draft volume in connection with the above-mentioned three modes, i.e. high drive mode (parallel drive mode), medium drive mode (single drive mode) and low drive mode (serial drive mode) is 4:2:1.

For this reason, it is possible to precisely or finely effect a reasonable control in accordance with various kinds of conditions e.g. when an air conditioner is used, immediately after the engine starts, when the engine is placed in idling operation, or when the engine rotates at a high speed etc.

In the above-mentioned embodiment, it has been described that the drive mode shift control for motor-fans is carried out using thermoswitches and relay circuit etc. However, it will be apparent that such a drive mode shift control may be effected using a microcomputer.

Further, in the above-mentioned embodiment, it has been described that serial/parallel drive control is applied to the two motor system. However, it is needless to say that the present invention is applicable to other motor system, e.g. four motor system etc.

As stated above, the cooling system for a vehicle according to the present invention can properly and finely control the draft in correspondence with delicate changes in engine operating condition. Further, the cooling system of the invention can prevent noise produced due to the fact that motor-fans are inadequately driven and improve fuel consumption rate.

It should be understood, of course, that the foregoing related only to preferred embodiments of the present invention and that numerous modifications or alterations may be made therein without departing from the spirit and scope of the invention as set forth in the appended claims.

What is claimed is:

1. A cooling system for a vehicle configured so as to vary draft volume to the radiator through which engine cooling medium is circulated in accordance with operating conditions of the engine, comprising:

a plurality of motor fans for air cooling the radiator, sensor means for sensing the temperature of the cooling medium at both the inlet and outlet sides of the radiator, and an operational mode control means, responsive to the outputs of said sensor means, for selectively controlling a plurality of operational modes programmed to selectively supply power to each of said plurality of motor-fans in order to optimize draft volume to the radiator, thereby enabling fine adjustment of draft volume to the radiator in order to effect a desired cooling of the engine;

wherein said operational modes include a parallel drive mode for parallely providing power to each of said plurality of motor-fans, a serial drive mode for serially providing power thereto, a parallel drive mode for providing power to less than all of said plurality of motor-fans, and an OFF mode for disconnecting all said plurality of motor-fans from the power source; and wherein said operational mode control means selectively controls the control mode of the system according to the Table

| Conditions | | 1 | 2 | 3 | 4 | 5 | 6 | 7 | 8 |
|---|---|---|---|---|---|---|---|---|---|
| air conditioner switch | OFF | o | o | o | o | | | | |
| | ON | | | | | o | o | o | o |
| Temperature of water from radiator | up to $T_1$ | o | | o | | o | | o | |
| | above $T_1$ | | o | | o | | o | | o |
| Temperature of water into radiator | up to $T_2$ | o | o | | | o | o | | |
| | above $T_2$ | | | o | o | | | o | o |
| driving mode of motor-fans | | OFF | LO | MI | HI | LO | LO | HI | HI |

wherein $T_2$ is greater than $T_1$, HI indicates a parallel drive mode, MI indicates a partial drive mode, LO indicates a serial drive mode and OFF indicates an OFF mode.

2. A cooling system of claim 1, wherein said sensor means comprises thermal elements or switches.

3. A cooling system of claim 2, wherein each said thermoswitch comprises a thermostatic switch or a thermister.

4. A cooling system of claim 1, wherein said operational mode control means comprises a combination of electro-magnetic relays responsive to said sensor means to energize a desired motor-fan or fans in accordance with the selected operational mode.

* * * * *